US012667147B2

(12) United States Patent
Ilsitz et al.

(10) Patent No.: US 12,667,147 B2
(45) Date of Patent: Jun. 30, 2026

(54) ARC FLASH PROTECTION GLOVE

(71) Applicant: DEHN SE, Neumarkt i.d.OPf. (DE)

(72) Inventors: Andrea Ilsitz, Neumarkt (DE); Rainer Ziehmer, Fuldatal (DE); Johannes Pirkl, Pilsach (DE)

(73) Assignee: DEHN SE, Neumarkt i.d. OPf (DE)

( * ) Notice: Subject to any disclaimer, the term of this patent is extended or adjusted under 35 U.S.C. 154(b) by 0 days.

(21) Appl. No.: 18/834,000

(22) PCT Filed: Jan. 27, 2023

(86) PCT No.: PCT/EP2023/052039

§ 371 (c)(1),
(2) Date: Jul. 29, 2024

(87) PCT Pub. No.: WO2023/148101

PCT Pub. Date: Aug. 10, 2023

(65) Prior Publication Data

US 2025/0120460 A1 Apr. 17, 2025

(30) Foreign Application Priority Data

Feb. 7, 2022 (DE) ..... 102022102817.8

(51) Int. Cl.
*A41D 19/015* (2006.01)
*A41D 19/00* (2006.01)
*A41D 31/26* (2019.01)

(52) U.S. Cl.
CPC ... *A41D 19/01529* (2013.01); *A41D 19/0006* (2013.01); *A41D 31/265* (2019.02); *A41D 2500/50* (2013.01); *A41D 2600/20* (2013.01)

(58) Field of Classification Search
CPC ..... A41D 19/01529; A41D 19/0006; A41D 31/265; A41D 2500/50; A41D 2600/20
See application file for complete search history.

(56) References Cited

U.S. PATENT DOCUMENTS 2,295,507 A 9/1942 Wells, Jr. et al. ..... 2/161.6
4,624,016 A 11/1986 Luevano ..... 2/19
(Continued)

FOREIGN PATENT DOCUMENTS

GB 114517 A 4/1918 ..... A41D 19/015
WO WO-2015066752 A1 * 5/2015 ..... A41D 19/001
WO WO2021005430 A1 1/2021 ..... A41D 19/015

OTHER PUBLICATIONS

The Notification Concerning Transmittal of International Preliminary Report on Patentability (Chapter I of the Patent Cooperation Treaty), in English, dated Aug. 22, 2024, which was issued by the International Bureau of WIPO in Applicant's corresponding international PCT application having Serial No. PCT/EP2023/052039, filed on Jan. 27, 2023.

(Continued)

*Primary Examiner* — Alissa L Hoey
*Assistant Examiner* — Akwokwo Olabisi Redhead
(74) *Attorney, Agent, or Firm* — Bodner & Bodner, PLLC; Christian P. Bodner; Gerald T. Bodner

(57) ABSTRACT

The invention relates to an arc fault protective glove for the protection against the thermal effects of an arc fault, wherein the arc fault protective glove includes a palm section which is assigned to a palm when the arc fault protective glove is worn, and a glove back opposite to the palm section, which is assigned to the back of a hand when the arc fault protective glove is worn. The palm section has a multilayer structure. The multilayer structure comprises at least a first layer and a second layer, wherein the first layer is sewn to the second layer in an edge area of the second layer.

14 Claims, 2 Drawing Sheets

(56) References Cited

U.S. PATENT DOCUMENTS

| | | | | |
|---|---|---|---|---|
| 9,555,567 | B2 * | 1/2017 | Gellis | A41D 19/015 |
| 2005/0278829 | A1 * | 12/2005 | Geng | A41D 19/01505 2/169 |
| 2009/0222980 | A1 * | 9/2009 | Klug | A41D 19/01529 2/81 |
| 2009/0276933 | A1 * | 11/2009 | Dodd | A41D 13/081 2/22 |
| 2017/0295869 | A1 * | 10/2017 | Choi | A41D 19/01523 |
| 2019/0191798 | A1 * | 6/2019 | Stegmaier | B32B 3/30 |
| 2023/0030732 | A1 * | 2/2023 | Harris | A41D 19/015 |

OTHER PUBLICATIONS

The English translation of the International Preliminary Report on Patentability (Chapter I of the Patent Cooperation Treaty), dated Aug. 6, 2024, which was issued by the International Bureau of WIPO in Applicant's corresponding international PCT application having Serial No. PCT/EP2023/052039, filed on Jan. 27, 2023.

The Written Opinion of the International Searching Authority, in English, dated Apr. 12, 2023, which was issued by the International Bureau of WIPO in Applicant's corresponding international PCT application having Serial No. PCT/EP2023/052039, filed on Jan. 27, 2023.

The International Search Report, in English, dated Apr. 12, 2023, which was issued by the International Bureau of WIPO in Applicant's corresponding international PCT application having Serial No. PCT/EP2023/052039, filed on Jan. 27, 2023.

* cited by examiner

ARC FLASH PROTECTION GLOVE

The invention relates to an arc fault protective glove.

When working on electrical systems, there is generally a risk of an arc fault. For example, if two electrical components are insufficiently insulated, an undesired voltage flashover may occur between the two components, as a result of which an arc fault can form.

An arc fault can release a large amount of energy within a short period of time, so that an arc fault causes a high thermal load for the immediate surroundings. In addition to this thermal load, an arc fault also involves further hazards, such as the generation of hot metal spatters and glowing metal particles as a result of electrode processes and other influences.

To minimize the risk of personal injury due to arc faults, it is necessary to wear suitable personal protective equipment. When working on electrical systems, the hand and forearm area is usually exposed to a higher risk of burns due to arc faults. The use of suitable protective gloves is therefore particularly advantageous.

Consequently, efforts are made to provide protective gloves which offer a suitable protection against the thermal effects of an arc fault. Suitable protective gloves should, on the one hand, have a high wearing comfort so as to not restrict mobility when wearing the gloves, and, on the other hand, provide sufficient protection against the thermal effects of an arc fault. These two requirements are often difficult to reconcile and sometimes even contradictory.

To ensure an optimum protection against an arc fault, the materials used for the protective glove often have to be chosen correspondingly thick and stable, which in turn usually increases the stiffness of the protective glove and accordingly restricts the freedom of movement of the hand. In particular, a stiffer protective glove restricts the mobility of the fingers, which is disadvantageous for performing complex works for which corresponding fine motor skills of the fingers are required.

The invention is therefore based on the object to provide an arc fault protective glove which offers sufficient protection against the thermal effects of an arc fault and at the same time ensures a sufficient freedom of movement when worn.

According to the invention, the object is achieved by an arc fault protective glove according to claim 1.

Advantageous embodiments of the arc fault protective glove according to the invention are specified in the subclaims the features of which can optionally be combined with each other.

According to the invention, the object is achieved by an arc fault protective glove for the protection against the thermal effects of an arc fault. The arc fault protective glove includes a palm section which is assigned to a palm when the arc fault protective glove is worn, and a glove back opposite to the palm section, which is assigned to the back of a hand when the arc fault protective glove is worn. The palm section has a multilayer structure. The multilayer structure comprises at least a first layer and a second layer, wherein the first layer is sewn to the second layer in an edge area of the second layer.

The invention is based on the basic idea to provide a palm section of an arc fault protective glove with a multilayer structure composed of at least two layers which are sewn to each other, so that the palm is in particular protected against the thermal effects of an arc fault when the arc fault protective glove according to the invention is worn. In other words, the arc fault protective glove is only partially reinforced on the palm by the multilayer structure.

In this way, the areas of the hand most exposed when working on electrical systems, namely the palms, can be protected without having to fully reinforce and thus stiffen the glove.

This offers the technical advantage that the palms are particularly protected and at the same time the freedom of movement of finger elements of the arc fault protective glove is maintained. The proposed arc fault protective glove thus offers a high waring comfort and does not restrict the user when wearing the arc fault protective glove. The arc fault protective glove is furthermore cost-effective as the two layers are only sewn together.

The first layer or the second layer may extend only over part of the total width of the arc fault protective glove in a lower and/or central area of the palm section.

On an inner glove surface of the arc fault protective glove, the palm section may adjoin a thumb section in the lower and/or central area, which together define the total width of the arc fault protective glove in the corresponding area.

In an upper area of the palm section, which is in particular assigned to the base joints of the fingers when the arc fault protective glove is worn, the palm section and thus the first layer and the second layer may extend over the entire width of the arc fault protective glove. In this respect, the first layer or the second layer does not extend over the entire width of the arc fault protective glove in an area which reaches up to the base joints of the fingers when the arc fault protective glove is worn.

In particular with regard to the material composition, the thumb section has a structure which differs from that of the palm section.

One aspect provides that the second layer is sewn to the first layer by means of a seam which is designed as a single seam and/or is formed by an aramid thread. The use of a single seam offers the advantage that the two layers can be sewn together in a cost-effective manner. Furthermore, the use of an aramid thread ensures that the seam does not open when exposed to heat, so that the palm section is accordingly resistant. A seam with an aramid thread is therefore heat and flame resistant.

In one embodiment, the first layer and the second layer each have a thickness in the range from 0.3 to 2.0 mm, preferably from 0.5 to 1.5 mm, particularly preferably from 1.0 to 1.2 mm. Depending on the material used for the respective layer, it is thus ensured that there is a compromise between the wearing comfort and a heat or flame protection.

According to a further aspect, the first and the second layer are made of leather. Genuine leather, in particular cowhide leather, can preferably be used as leather. Leather is breathable and thus offers a high comfort when the arc fault protective glove is worn. Leather is furthermore a flexible material. The entire arc fault protective glove is therefore accordingly flexible. Such an arc fault protective glove offers the wearer a high freedom of movement. Leather additionally has the advantage to be compatible with a multitude of other textiles and fabrics, as a result of which it can be processed, in particular sewn, particularly easily.

The arc fault protective glove can therefore be manufactured in a particularly cost-effective way.

Advantageously, the leather is provided with a flame protection coating, the leather being in particular siliconized. Due to siliconization, the leather is not only provided with a flame protection coating, but also has an electrically insulating effect.

The flame protection coating is preferably applied to the outside of the outer layer of the arc fault protective glove designed as leather. This may involve the second layer on the inner glove surface of the arc fault protective glove, namely in the palm section, or the first layer.

In one embodiment, the first layer extends up to ends of finger elements of the arc fault protective glove. The first layer in particular corresponds to a base layer of the arc fault protective glove which extends over the entire length of the arc fault protective glove, i.e. from an open end for putting on the arc fault protective glove, up to closed ends of the finger elements.

According to a further aspect, the arc fault protective glove has a forearm area and a hand area, wherein the hand area comprises, among others, the palm section. The forearm area is in particular designed as a cuff which completely surrounds a forearm in the circumferential direction when worn. The forearm of a wearer can thus also be at least partially protected against the effects of an arc fault. On the end side, the forearm area also includes the open end for putting on the arc fault protective glove. The open end is therefore the free end of the forearm area which is opposite to the end of the forearm area which merges into the hand area.

Advantageously, an elastic band is provided on the inside between the forearm area and the hand area, in particular wherein the elastic band is sewn using an aramid fiber. In this way, the correct fit when the arc fault protective glove is worn can be adapted to the respective wearer. In addition, the band constricts the glove in the area of the wrist of the wearer when worn. Advantageously, the penetration of dirt and foreign particles into the inner area of the arc fault protective glove can thus be prevented. The elastic band is sewn on the inside, i.e. on the inner side of the arc fault protective glove. Furthermore, the elastic band is provided only on the inner glove surface of the arc fault protective glove, which comprises the palm section.

According to a further aspect, the palm section is located on an inner side of the arc fault protective glove, the palm section adjoining a thumb section which is formed of three layers. This offers the technical advantage that the thumb can be reinforced or protected separately from the remaining arc fault protective glove and the mobility of the remaining glove areas is maintained. At the same time, the back area of the thumb is stabilized so that the protective function of the glove is increased, but a gripping movement when wearing the glove is not restricted.

Advantageously, the glove back is formed of three layers. The glove back is usually subject to different requirements in terms of mobility and protection, so that the glove back may be made of a material composition different than that of the palm section. The three-layer material composition of the glove back may comprise different materials to satisfy the requirements.

In principle, the glove back formed of the three layers is sewn to the first layer and/or the second layer which at least partially forms the inner glove surface of the arc fault protective glove opposite to the glove back.

In one embodiment, the three layers extend from the glove back up to the ends of finger elements. The arc fault protective glove can therefore cover the entire back of the hand up to the fingertips when worn. The three layers increase the protective function of the glove without restricting the freedom of movement of the finger elements.

According to a further aspect, the first layer is designed as an inner lining which forms the inner side of the arc fault protective glove, wherein the inner lining preferably comprises an aramid fabric, the second layer is designed as a backing layer connected to the inner lining which preferably comprises a chloroprene rubber, and the third layer is provided as a flame protection layer which is arranged on the side of the backing layer which faces away from the inner lining and forms the outer side of the protective glove. The inner lining formed from an aramid fabric improves, on the one hand, the wearing comfort and, on the other hand, increases the fire resistance of the arc fault protective glove.

The chloroprene rubber, also known as neoprene, which is arranged in the backing layer serves to compensate for the shrinkage behavior of leather, i.e. the first layer and/or the second layer due to the high temperatures of an arc fault. The foamed chloroprene rubber has particularly good insulating properties, which further increases the heat resistance of the arc fault protective glove.

The aramid fabric is thus the inner layer, whereas the flame protection layer is the outer layer, i.e. the outer surface of the arc fault protective glove.

The thumb section is in particular made of the same material composition as the glove back, i.e. of three layers.

Furthermore, the arc fault protective glove may have an intermediate section which adjoins the thumb section and is provided in the forearm area. The intermediate section is also made of the same material composition as the glove back, i.e. of three layers.

The thumb section and the intermediate section are in particular a common section which is provided both in the forearm area and in the hand area. The common section preferably extends from the open end in the forearm area up to the closed end of the finger element for the thumb.

The flame protection layer can comprise a foamed chloroprene rubber which is optionally provided with an additive. The additive may be carbon, in particular in the form of carbon black. In this respect, the flame protection layer may be made of a material, in particular neoprene, which is a self-contained, extruded and vulcanized cellular rubber to which carbon black or pure carbon is added.

In one embodiment, the inner lining is bonded to the backing layer and furthermore sewn thereto and/or to the first layer by means of a double seam in a transition area of the backing layer.

The backing layer may be sewn to the inner lining and/or the first layer by means of a double seam.

The double seam is in particular formed by at least one aramid thread. A particularly stable connection of the two layers can be achieved due to the double connection. In other words, the double seam ensures a connection between the different materials which can permanently withstand stresses occurring during wear.

According to one embodiment, the flame protection layer is laminated onto the backing layer. A plurality of layers made of the same or of different materials can be connected simultaneously during lamination.

A hem seam is provided at the open end of the forearm area, which is in particular designed as a single seam which runs in a zig-zag shape along the hem. The hem seam is formed using an aramid thread.

Aramid is basically also known under the name Kevlar.

Aramid fibers used as threads for the seams or the aramid fabric, are heat-resistant, synthetic fibers which offer a very high strength at a very low weight.

The arc fault protective glove according to the invention ensures in addition to a high wearing comfort and a high freedom of movement of the finger elements, a reliable protection against the thermal effects of an arc fault and a flame protection.

In addition, the arc fault protective glove according to the invention complies with the basic requirements of DIN EN 407:2004-11.

To furthermore ensure a reliable protection against the effects of an arc fault, the proposed arc fault protective glove also complies with the "Additional requirements for the testing and certification of heat protection gloves for protection against the thermal effects of an arc fault" in accordance with DGUV test GS-ET-42-2:2019-02, APC 2_150.

In Germany, these additional requirements are achieved by means of arc fault strength tests on protective gloves in accordance with the test principle GS-ET-42-2 of DGUV, German Employers' Liability Insurance Association for the Energy, Textile, Electrical and Media Products sector.

The structure and the procedure of the arc fault resistance tests in accordance with DGUV test GS-ET-42-2:2019-02, APC 2_150 are outlined in the following. More detailed information on the test conditions can be found in the test principle GS-ET-42-2 "Additional requirements for the testing and certification of heat protection gloves for protection against the thermal effects of an arc fault" dated February 2019.

To test protective gloves, an arc fault with a defined energy input is generated in an open arc arrangement. The arc fault is ignited between two electrodes which represent the center of a semi-circular measuring arrangement of sample and sensor holders. The measuring arrangement is composed of three sample holders which are provided with sensors for calorimetric heat measurement. During a test, three gloves which are arranged on the respective sample holders, are tested in parallel. The protective gloves to be tested are pulled over the respective sample holders so that the sensor for the calorimetric heat measurement are located inside the glove. The gloves are in addition arranged at a test distance of 150 mm to the axis connecting the two electrodes.

A defined number of arcs is then generated for the test, and the effects of the heat input of the arcs on the protective gloves are determined using criteria defined in advance. The test is carried out (separately) both for the front and the back of the gloves.

In this respect, an arc fault protective glove is basically a special glove having defined properties, as results from the above explanations.

Therefore, the arc fault protective glove is heat and/or flame resistant or has a heat and/or flame protection. This can be realized in that the arc fault protective glove, in particular the outside of the arc fault protective glove, comprises a material which is heat and/or flame resistant or provides the heat and/or flame protection. An (outer) coating may (additionally) be provided, which is heat and/or flame resistant or provides the heat and/or flame protection.

An arc fault protective glove thus has to be suitable for protection against the thermal effects of an arc fault. Accordingly, this can obviously not be a sports glove or a glove for everyday use.

The invention is described in more detail below by means of a preferred example embodiment and with reference to the accompanying drawings, in which.

Figure 1:
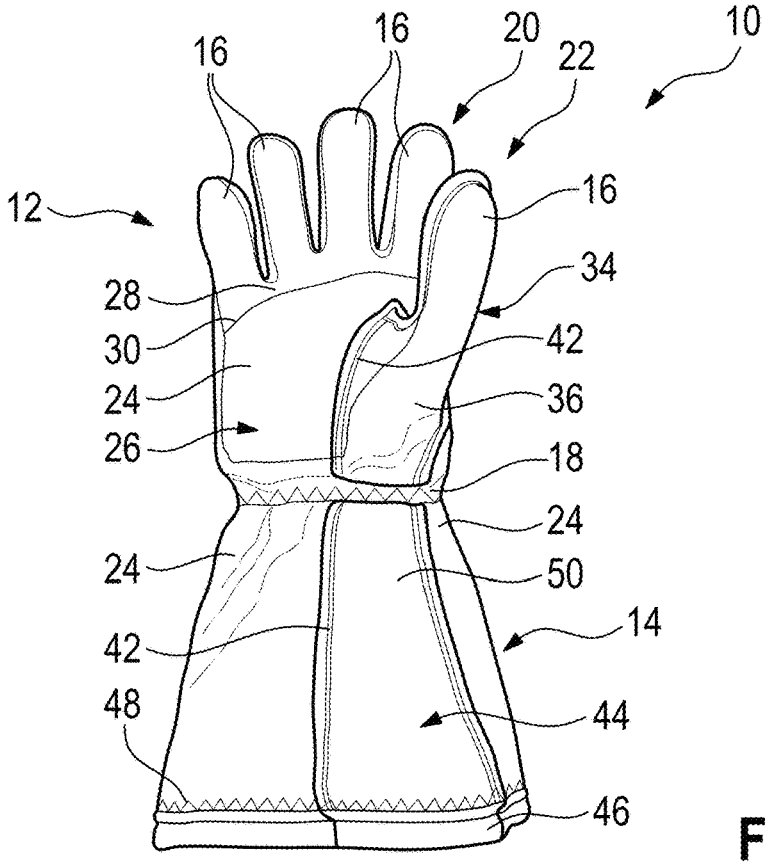
FIG. 1 shows an isometric representation of an inside of an inner glove surface of an arc fault protective glove according to the invention.
Figure 2:
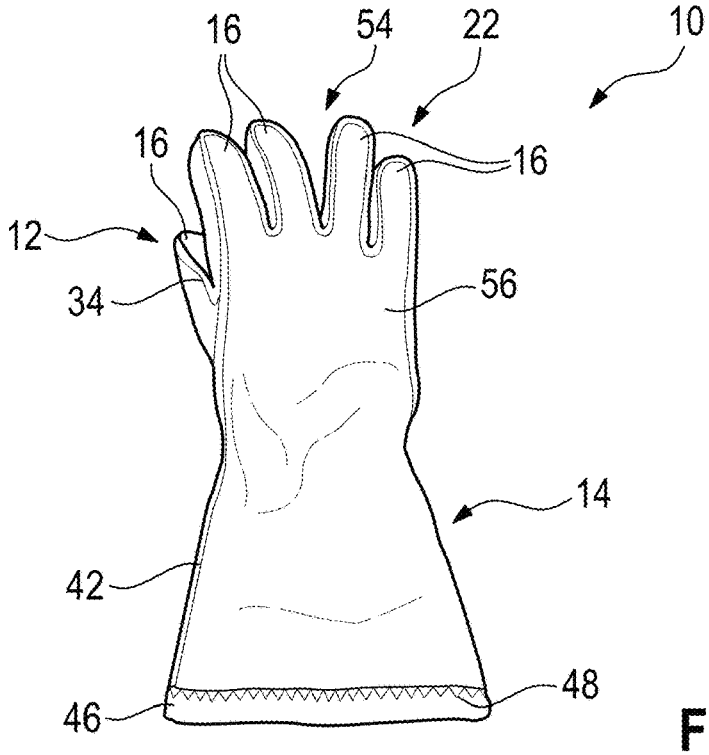
FIG. 2 shows an isometric representation of an inside of a glove back of the arc fault protective glove according to the invention.
Figure 3:
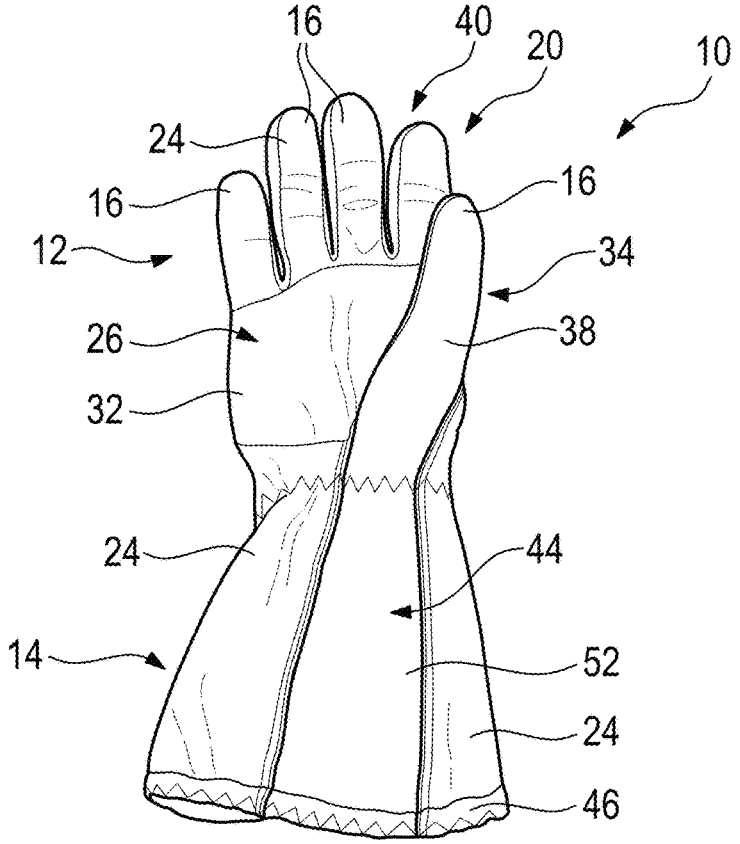
FIG. 3 shows an isometric representation of an outside of the inner glove surface of the arc fault protective glove according to the invention.
Figure 4:
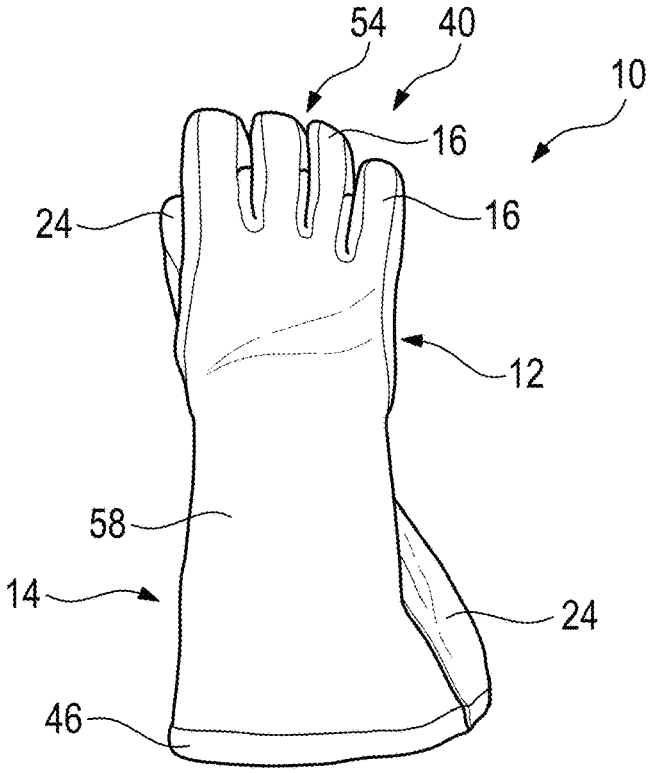
FIG. 4 shows an isometric representation of an outside of the glove back of the arc fault protective glove according to the invention.

FIGS. 1 to 4 show the structure of an arc fault protective glove 10, FIGS. 1 and 2 explaining the structure of the inner sides, whereas FIGS. 3 and 4 show the structure of the outer sides of the arc fault protective glove 10.

The arc fault protective glove 10 shown in FIGS. 1 to 4 basically consists of a hand area 12 and a forearm area 14. The arc fault protective glove 10 thus serves both to protect the hand of the wearer and also to protect the forearm.

The hand area 12 corresponds to the negative of a human hand and is designed such that it can accommodate and completely surround a human hand. For this purpose, the hand area 12 includes a total of five finger elements 16 which can fully accommodate the fingers of a hand when worn. The forearm area 14 is configured so as to fully enclose a forearm in the circumferential direction when worn.

To ensure the correct fit of the arc fault protective glove 10, an elastic band 18 is additionally provided on the inner side at the transition from the forearm area 14 to the hand area 12, i.e. only in the area of an inner glove surface 20 which is shown in FIG. 1.

The elastic band 18 constricts the arc fault protective glove 10 in the area of the wrist of the wearer, i.e. between the forearm area 14 and the hand area 12. The elastic band 18 is in particular sewn to the hand area 12 and/or the forearm area 14. The seam is preferably formed by an aramid thread.

FIG. 1 shows the structure of an inner side 22 of the inner glove surface 20 of the arc fault protective glove 10.

In other words, the inner side 22 of the arc fault protective glove 10 shown in FIG. 1 is turned to the outside for a better overview, or the arc fault protective glove 10 is turned inside out.

The inner side 22 of the hand area 12 is formed by a first layer 24. The first layer 24 is designed so as to form the inner side of the finger elements 16, the inner side of a palm section 26 and the inner side of the forearm area 14. In this respect, the first layer 24 corresponds to a base layer of the arc fault protective glove 10 which extends over the entire length of the arc fault protective glove 10.

The first layer 24 is made of a leather, in particular a genuine leather, particularly preferably a cowhide leather.

The palm section 26 only covers the palm of a hand when worn. The palm section 26 is therefore provided between the finger elements 16 and the forearm area 14.

The palm section 26 has an edge area 28 which is provided with a seam 30 designed as a single seam. The single seam 30 in particular comprises an aramid thread.

The seam 30 is intended to sew the first layer 24 to an additional second layer 32 which is provided only in the palm section 26 and thus reinforces the first layer 24 in the region of the palm section 26, as can be seen from FIG. 3, which shows the outer side of the inner glove surface 20 of the arc fault protective glove 10. The seam 30 runs in the edge area 28 of the second layer 32, as can be seen in FIG. 3.

Basically, the first layer 24 and the second layer 32 each have a thickness in the range from 0.3 to 2.0 mm, preferably from 0.5 to 1.5 mm, particularly preferably from 1.0 to 1.2 mm.

A thumb section 34 which is connected, in particular sewn to the palm section 26 is provided adjacent to the palm section 26.

The thumb section 34 is designed so as to fully cover the back of the thumb when worn. In contrast thereto, the inner side of the thumb is covered by the first layer 24.

The thumb section 34 is formed from three layers arranged one above the other.

The three layers consist of an inner thumb lining 36 (first layer), which is clearly visible in FIG. 1 and forms part of the inner side 22 of the arc fault protective glove 10.

In addition, the three-layer thumb section 34 comprises a backing layer (second layer—not shown here), which is bonded to the inner thumb lining 36.

Furthermore, the palm section 26 has a flame protection layer 38 (third layer—see FIG. 3), which forms part of an outer side 40 of the arc fault protective glove 10 and is arranged on a side of the backing layer which faces away from the inner thumb lining 36.

The inner thumb lining 36 in particular consists of an aramid fabric which is also referred to as Kevlar fabric.

The backing layer in particularly consists of a chloroprene rubber, which is also referred to as neoprene.

The flame protection layer 38 consists of a foamed chloroprene rubber which is optionally provided with a special additive.

The additive may be carbon, in particular in the form of carbon black.

The flame protection layer 38 can be formed of a material, in particular a neoprene, which is a self-contained, extruded and vulcanized cellular rubber to which carbon black or pure carbon is added.

The inner thumb lining 36 has an edge area in which a double seam 42 is provided. The double seam 42 connects the thumb section 34, in particular the inner thumb lining 36 and/or the backing layer, to the first layer 24 and/or the second layer 32 (in the area of the palm section 26). The corresponding double seam 42 runs in a transition area between the different materials.

The inner thumb lining 36 can thus be both bonded and sewn to the backing layer.

The thumb section 34 further merges into an intermediate section 44 which is provided in the forearm area 14 described at the beginning. The intermediate section 44 is also sewn to the first layer 24 by means of the double seam 42, in particular in a transition area.

At the end opposite the hand area, i.e. the open end, the forearm area 14 ends with a hem 46 which has a single seam 48, provided as a zig-zag seam.

The hem 46 extends completely in the circumferential direction and forms the opening for inserting the hand into the arc fault protective glove 10.

Like the thumb section 34, the intermediate section 44 is formed from the aforementioned three layers. This means that the intermediate section 44 has an inner lining 50 which forms part of the inner side 22 of the arc fault protective glove 10. The inner lining 50 in particular comprises an aramid fabric.

The inner lining 50 is arranged on a backing layer (not shown here), in particular bonded thereto, the backing layer consisting of a chloroprene rubber.

On a side of the backing layer which faces away from the inner lining 50, a flame protection layer 52 is provided which forms part of the outer side 40 of the arc fault protective glove 10. The flame protection layer 52 in particular consists of a foamed chloroprene rubber which is optionally provided with a special additive.

In principle, the seams are formed by aramid threads, i.e. Kevlar threads.

FIG. 2 shows the inner side 22 of a glove back 54 of the arc fault protective glove 10.

The glove back 54 in particular covers the forearm area 14 and the hand area 12. In addition, the glove back 54 extends from the hem 46 to the ends of finger elements 16.

The glove back 54 has the same three-layer structure as the thumb section 34 and the intermediate section 44.

The glove back 54 thus has an inner lining 56 on the back of the hand, which faces the back of the hand when worn, i.e. the inner side 22 of the arc fault protective glove 10.

The inner lining 56 on the back of the hand in particular consists of an aramid fabric.

The inner lining 56 on the back of the hand is bonded to a backing layer (not shown here). In particular, the inner lining 56 on the back of the hand is sewn in an edge area to the backing layer and/or to the first layer 24 of the arc fault protective glove 10 which serves as a base layer using a double seam 42. The double seam 42 is formed by an aramid thread.

The backing layer is made of a chloroprene rubber.

Furthermore, the glove back 54 has a flame protection layer 58 which is provided on a side of the backing layer which faces away from the inner lining 56 on the back of the hand, the flame protection layer 58 being in particular made of a foamed chloroprene rubber which is optionally provided with a special additive.

As already explained, the glove back 54 is sewn to the first layer 24 which forms finger side sections of the arc fault protective glove 10. The first layer 24 is preferably sewn to the glove back 54 by a single seam which is in particular formed by an aramid thread.

FIG. 3 shows the outer side 40 of the inner glove surface 20 of the arc fault protective glove 10.

FIG. 3 basically shows the same components and features as FIGS. 1 and 2, and in this respect, reference is made to the description of FIGS. 1 and 2.

As is clearly visible in FIG. 3, the inner glove surface 20 of the arc fault protective glove 10 has the additional second layer 32 which is assigned to the palm section 26. The first layer 24 of the arc fault protective glove 10 serving as a base layer is therefore accordingly reinforced in the area of the palm section 26.

The second layer 32 is in particular sewn to the underlying first layer 24 (as seen from the outside) by means of a single seam 30 in an edge area 28 of the palm section 26.

In particular, the seams have been produced using an aramid thread.

Furthermore, the seams are placed on the inside so that they are not visible on the outer side of an arc fault protective glove 10.

The second layer 32 is made of a leather, preferably a genuine leather, particularly preferably a cowhide leather.

In this respect, both the first layer 24 and the second layer 32 are made of the same material, namely a leather, for example a genuine leather such as a cowhide leather.

The leather may be provided with a flame protection coating, the leather being in particular siliconized to form the flame protection coating.

In other words, the second layer 32 covers the palm of a wearer of the arc fault protective glove 10, while the inner surfaces of the finger elements 16, in particular of the thumb, are only covered by the first layer 24.

In this way, the protection against the thermal effects of an arc fault can be increased without restricting the freedom of movement when wearing the arc fault protective glove 10.

Due to the arrangement of the second layer 32 in the area of the palm section 26, the finger elements 16 in particular remain movable.

As in FIG. 3, the arc fault protective glove 10 is turned right side out, the outermost layer of the three-layer structure described above is now visible on the thumb section 34. It is formed by a flame protection layer 38. The flame protection layer 38 extends from the end of the finger element 16 intended for the thumb, up to the intermediate section 44 which also has a three-layer structure, i.e. also the flame protection layer 52, which extends up to the hem 46. Therefore, a section of the forearm area 14 is also covered by the flame protection layer 52. This section also has the three-layer structure already described above.

In principle, the thumb section 34 and the intermediate section 44 can together form a section, as can be seen in particular from FIG. 3. The two sections 34, 44 are overlaid by the elastic band 18 only on the inside and are thus functionally separated from each other. However, the elastic band 18 is attached to the inner first layer of the sections 34, 44, i.e. the inner lining 36, 50.

FIG. 4 shows the outer side 40 of the glove back 54 of the arc fault protective glove 10.

On the outer side 40, the glove back 54 consists of the flame protection layer 58. The flame protection layer 58 of the glove back 54 extends from the ends of finger elements 16 up to the hem 46 of the forearm area 14.

The invention claimed is:

1. An arc fault protective glove for the protection against the thermal effects of an arc fault, wherein the arc fault protective glove has a forearm area and a hand area, wherein the hand area includes a palm section which is assigned to a palm when the arc fault protective glove is worn, wherein the arc fault protective glove also has a glove back opposite to the palm section at least, which is assigned to the back of a hand when the arc fault protective glove is worn, wherein the palm section has a multilayer structure, wherein the multilayer structure comprises at least a first layer and a second layer, wherein the first layer of the palm section and the second layer of the palm section are made of leather, wherein the second layer does not extend over the entire width of the arc fault protective glove in an area which reaches up to the base joints of the fingers when the arc fault protective glove is worn, wherein the first layer of the palm section is sewn to the second layer of the palm section in an edge area of the second layer of the palm section such that the first layer of the palm section is designed as an inner lining at least in the palm section where the second layer of the palm section forms part of an outer side of the arc fault protective glove, wherein the first layer of the palm section also forms part of an outer side of the arc fault protective glove in the forearm area, wherein the glove back is formed from three layers, wherein the first layer of the glove back is designed as the inner lining forms the inner side of the arc fault protective glove, wherein the inner lining comprises an aramid fabric, wherein the second layer of the glove back is connected to the inner lining, wherein the second layer of the glove back comprises a chloroprene rubber, and wherein a third layer of the glove back is provided as a flame protection layer which is arranged on the side of the second layer of the glove back facing away from the inner lining and forms the outer side of the protective glove.

2. The arc fault protective glove according to claim 1, wherein the second layer of the palm section is sewn to the first layer of the palm section by means of a seam, which is designed as a single seam and/or is formed by an aramid thread.

3. The arc fault protective glove according to claim 1, wherein the first layer of the palm section and the second layer of the palm section each have a thickness in the range from 0.3 to 2.0 mm.

4. The arc fault protective glove according to claim 1, wherein the leather is provided with a flame protection coating.

5. The arc fault protective glove according to claim 1, wherein the first layer extends up to ends of finger elements of the arc fault protective glove.

6. The arc fault protective glove according to claim 1, wherein an elastic band is provided on the inside between the forearm area and the hand area.

7. The arc fault protective glove according to claim 6, wherein the elastic band is sewn using an aramid thread.

8. The arc fault protective glove according to claim 1, wherein the palm section is located on an inner glove surface of the arc fault protective glove, wherein the palm section adjoins a thumb section formed from three layers.

9. The arc fault protective glove according to claim 1, wherein the three layers extend from the glove back up to ends of finger elements.

10. The arc fault protective glove according to claim 1, wherein the inner lining is bonded to the second layer and is further sewn thereto and/or to the first layer by means of a double seam in a transition area of the second layer.

11. The arc fault protective glove according to claim 10, wherein the double seam is formed by an aramid thread.

12. The arc fault protective glove according to claim 1, wherein the flame protection layer is laminated onto the second layer.

13. An arc fault protective glove for the protection against the thermal effects of an arc fault, wherein the arc fault protective glove includes a palm section which is assigned to a palm when the arc fault protective glove is worn, and a glove back opposite to the palm section, which is assigned to the back of a hand when the arc fault protective glove is worn, wherein the palm section has a multilayer structure, wherein the multilayer structure comprises at least a first layer and a second layer, wherein the first layer and the second layer are made of leather, wherein the first layer is sewn to the second layer in an edge area of the second layer, wherein the first layer is made of leather and extends up to ends of finger elements of the arc fault protective glove, thereby forming an outer side of the arc fault protective glove in the area of the finger elements, wherein the second layer is made of leather, wherein the second layer does not extend over the entire width of the arc fault protective glove in an area which reaches up to the base joints of the fingers when the arc fault protective glove is worn, wherein the second layer forms the outer side of the arc fault protective glove in the palm section, and wherein a thumb section is sewn to the palm section consisting of leather.

14. An arc fault protective glove for the protection against the thermal effects of an arc fault, wherein the arc fault protective glove includes a palm section which is assigned to a palm when the arc fault protective glove is worn, and a glove back opposite to the palm section, which is assigned to the back of a hand when the arc fault protective glove is worn, wherein the palm section has a multilayer structure, wherein the multilayer structure comprises at least a first layer and a second layer, wherein the first layer and the second layer are made of leather, wherein the second layer does not extend over the entire width of the arc fault protective glove in an area which reaches up to the base joints of the fingers when the arc fault protective glove is worn, wherein the first layer of the palm section is sewn to the second layer of the palm section in an edge area of the second layer of the palm section, wherein the arc fault protective glove has a thumb section connected to the palm section, wherein the thumb section is designed so as to fully cover a back of the thumb when worn, wherein the thumb section is made of the same material composition as the glove back, whereas the glove back is made of a material composition different than that of the palm section, wherein the thumb section comprises an aramid fabric as inner lining to which a chloroprene rubber is bonded, and wherein the thumb section is sewn to the palm section.

* * * * *